US008806983B2

(12) United States Patent
Eifes

(10) Patent No.: US 8,806,983 B2
(45) Date of Patent: Aug. 19, 2014

(54) HOLDER FOR FASTENERS

(76) Inventor: Daniel Eifes, Harwinton, CT (US)

( * ) Notice: Subject to any disclaimer, the term of this patent is extended or adjusted under 35 U.S.C. 154(b) by 280 days.

(21) Appl. No.: 13/293,397

(22) Filed: Nov. 10, 2011

(65) Prior Publication Data

US 2013/0118314 A1 May 16, 2013

(51) Int. Cl.
*B25C 3/00* (2006.01)

(52) U.S. Cl.
USPC ..... 81/44

(58) Field of Classification Search
USPC ..... 81/44, 13, 487; 294/99.2
See application file for complete search history.

(56) References Cited

U.S. PATENT DOCUMENTS 1,715,819 A * 6/1929 Dealy ..... 81/44
4,079,765 A * 3/1978 Hatayan ..... 81/44
4,256,157 A * 3/1981 Grayson ..... 81/44
5,284,070 A * 2/1994 Rieck ..... 81/44
5,375,488 A * 12/1994 Baitner ..... 81/44
6,012,165 A 1/2000 Cain
7,467,573 B1 12/2008 Lee
7,866,931 B2 1/2011 Murtha
7,963,193 B2 6/2011 Morgan

FOREIGN PATENT DOCUMENTS

DE 4302559 A1 * 8/1994 ..... B25C 3/00

* cited by examiner

*Primary Examiner* — Hadi Shakeri
(74) *Attorney, Agent, or Firm* — Cantor Colburn LLP

(57) ABSTRACT

A holder for fasteners is provided. The holder includes a first body having a first portion and a second portion. The second portion extends from one end of the first portion. A second body is rotationally coupled to the first body, the second body having a third portion arranged adjacent the first portion and fourth portion. The fourth portion extends from one end of the third portion adjacent the second portion, the first portion and the third portion defining a gap. A magnetic member is coupled to the first body adjacent the second body.

15 Claims, 5 Drawing Sheets

HOLDER FOR FASTENERS

BACKGROUND OF THE INVENTION

The subject matter disclosed herein relates to a holder for fasteners, and in particular to a holder for holding nails while shielding the users fingers from being struck by a hammer.

Fasteners, such as nails for example, are commonly used to join material together. To join the materials, such as wood structures for example, together, the user may use a nail that is driven by a hammer from the first structure into the second structure. The compression of the material in the structures creates high frictional forces on the nail. These frictional forces hold the two structures together.

When a nail is initially installed, the user will hold the nail in the desired location and hit the "head" end with a hammer. This action initiates the driving of the nail into the first structure. Once the nail is inserted in a short distance, the compressive forces on the nail hold the nail in place without the aid of the users fingers. It should be appreciated that while this technique allows nails to be quickly inserted into the structure, it does expose the users fingers to being hit by the hammer if the user does not correctly strike the nail head.

Accordingly, while existing techniques for installing fasteners into a structure are suitable for their intended purposes, the need for improvement remains particularly in providing a device that shields the users fingers during the initial installation of the fastener.

BRIEF DESCRIPTION OF THE INVENTION

According to one aspect of the invention, a holder for fasteners is provided. The holder includes a first body having a first portion and a second portion, the second portion extending from one end of the first portion. A second body is rotationally coupled to the first body, the second body having a third portion arranged adjacent the first portion and fourth portion, the fourth portion extending from one end of the third portion adjacent the second portion, the first portion and the third portion defining a gap. A magnetic member is coupled to the first body adjacent the second body.

According to another aspect of the invention, a holder for fasteners is provided. The holder includes a first body having a first portion and a second portion, the second portion extending from one end of the first portion. A second body is movably coupled to the first body, the second body having a third portion arranged adjacent the first portion and fourth portion, the fourth portion extending from one end of the third portion adjacent the second portion, the first portion and the third portion defining a gap. Wherein the first portion and the second portion define a first area opposite the gap and the third portion and the fourth portion define a second area opposite the gap, wherein the first area and the second area are each sized to receive a finger.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

Figure 1:
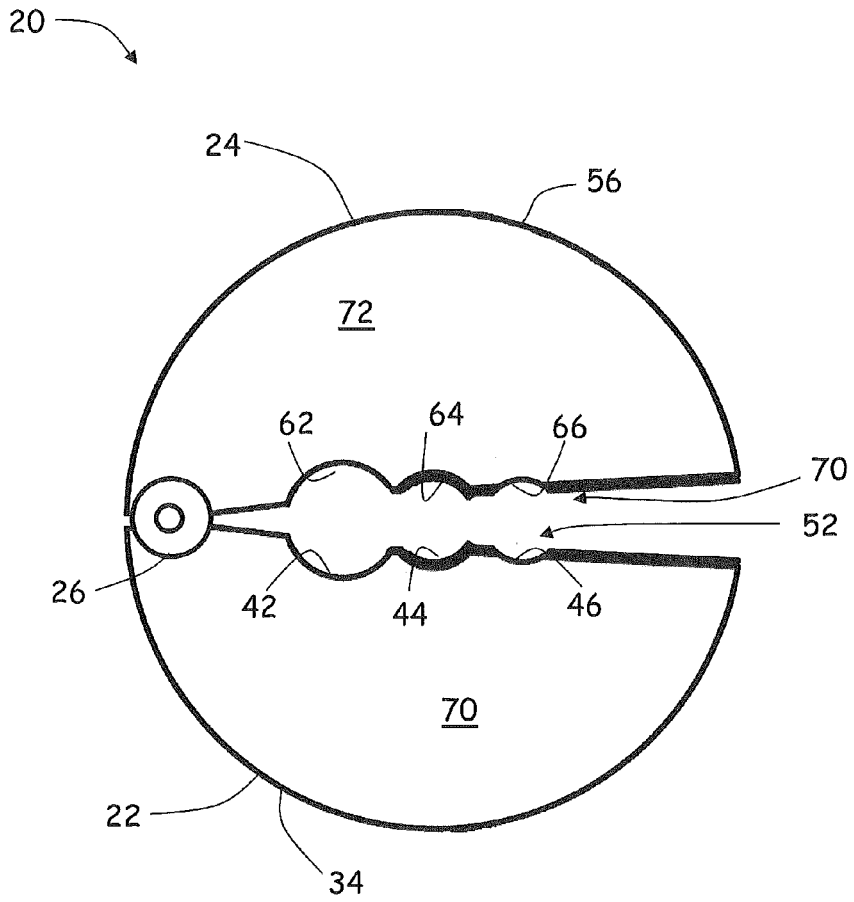
FIG. 1 is a top view of a holder in accordance with an embodiment of the invention.
Figure 2:
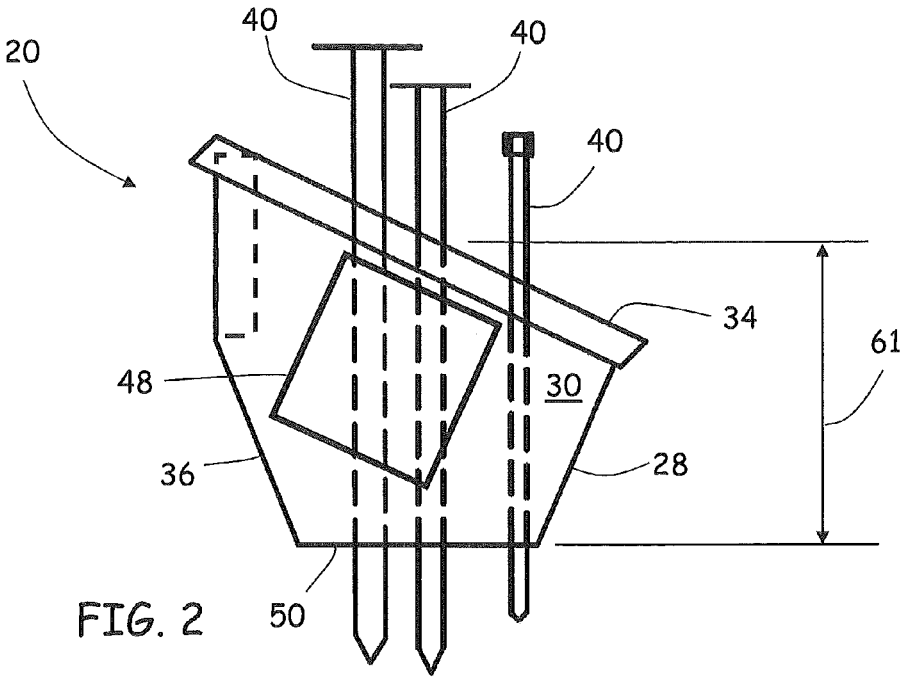
FIG. 2 is a side view of the holder of FIG. 1 with fasteners installed.
Figure 3:
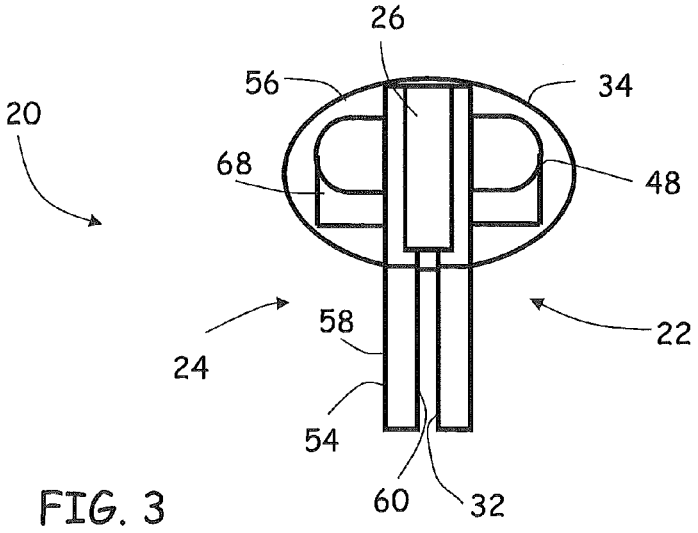
FIG. 3 is an end view of the holder of FIG. 1.
Figure 4:
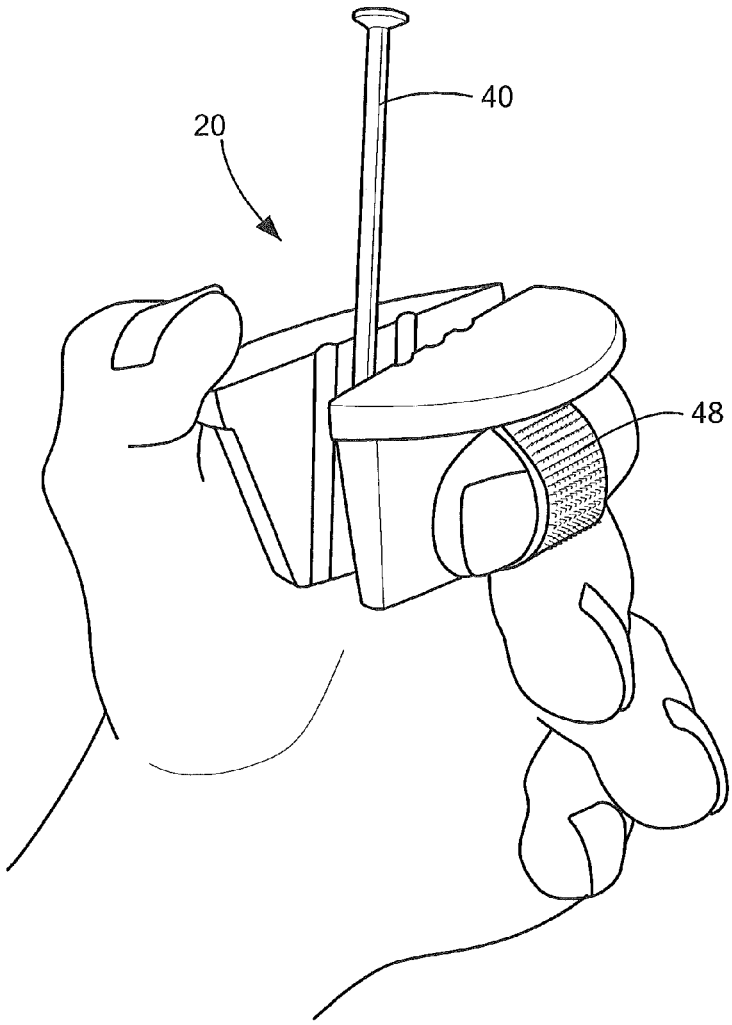
FIG. 4 is a perspective view of the holder of FIG. 1 with a fastener installed.

The detailed description explains embodiments of the invention, together with advantages and features, by way of example with reference to the drawings.

DETAILED DESCRIPTION OF THE INVENTION

Embodiments of the present invention provide for a holder that securely holds a fastener during the initial installation of the fastener into a structure. Embodiments of the present invention provide advantages in reducing the risk of the nail buckling. Embodiments of the present invention provide advantages in shielding the uses fingers while the fastener is installed. Embodiments provide advantages in allowing the fastener to be magnetically coupled to the holder. Embodiments of the invention provide a top surface arranged on an angle to allow the holder to be easily removed once the fastener has been initially inserted. Embodiments of the invention provide a holder that includes multiple slots that are sized to accept different size fasteners within the same holder.

Referring now to FIGS. 1-4, a holder 20 is shown in accordance with an exemplary embodiment of the invention. The holder includes a first body 22 and a second body 24. The bodies 22, 24 are coupled together by a hinge member 26. The bodies 22, 24 may be rotated between a first or closed position and a second or open position. As will be discussed in more detail herein, when in the closed position, the bodies 22, 24 retain a fastener for installation into a structure. In the exemplary embodiment, the bodies 22, 24 are made from a durable, impact resistant material, such as plastic materials that include but are not limited to thermoplastic, thermoset and composite materials.

The first body 22 includes a first portion 28 and a second portion 34 having an outer surface 30 and an inner surface 32. On one end, the first body 22 includes a surface 36 that is disposed on an angle relative to the second portion 34. As will be discussed in more detail herein, the angled surface 36 provides advantages in allowing the fastener 40 (FIG. 2) to be inserted into the structure at angle, a practice commonly referred to a toe-nailing. In the exemplary embodiment, the angle between the surface 36 and the second portion 34 is 45 degrees. The first body may further include an elastic member 48 that is sized to receive the user's finger to facilitate the holding of the holder 20 by the user. The member 48 provides advantages in assisting the user in holding the holder without having to grasp the entire holder during subsequent operational steps, such as reaching for additional fasteners, while climbing on a ladder or when reaching in overhead or other awkward positions. It should be appreciated that the first portion 28 and the second portion 34 define an area where the users fingers are located during use that is shielded from being struck by a hammer due by the second portion 34.

The inner surface may include one or more slots 42, 44, 46 that are sized to cooperate with corresponding slots in the second body 24 such that they are sized for holding a fastener during installation. In the exemplary embodiment, the slots are disposed on an angle relative to the second portion 34 and substantially perpendicular to a bottom surface 50. This arrangement provides advantages in that the angle allows the use to hold the holder 20 at a more natural angle during installation and facilitates the removal of the holder 20 once the fastener 40 has been driven into the structure.

The first body 22 may also have one or more magnetic members 52 disposed adjacent the inner surface 32. In one embodiment, magnetic member 52 may be a thin strip of magnetic material that is disposed on the inner surface 32. In another embodiment, the magnetic member 52 may be a thin strip of material disposed in the slots 42, 44, 46. In yet another embodiment, the magnetic member 52 may be embedded in the first body 22 adjacent each of the slots 42, 44, 46.

The second body 24 is substantially a mirror image of the first body 22. The second body 24 has a third portion 54, a fourth portion 56, an outer surface 58 and an inner surface 60. One or more slots 62, 64, 66 are disposed on the inner surface 60 and are arranged adjacent the corresponding slots 42, 44, 46 on the first body 22. In one embodiment, the slots 42, 62 are sized to receive a 10*d* nail and the slots 46, 66 are sized to receive a finish nail. A second member 68 may be arranged on the outer surface 58 to assist the user in holding onto the holder 20. The second body 24 may also include one or more magnetic member 70 disposed adjacent the inner surface 60. The first body 22 and second body 24 define a gap between the inner surfaces 32, 60 that are sized to receive the fastener 40 when in the closed position.

In one embodiment, the slots 44, 64 are positioned to be a distance 61 that is 1.2 inches (30.5 millimeters) from the bottom surface 50. In this embodiment, the surfaces 71, 72 form a substantially circular shape having a diameter of 2 inches (50.8 millimeters). In yet another embodiment, the diameter of the shape formed by the surfaces 71, 72 is sized to allow the holder 20 to be rotated on its side such that the edge of the second portion 34 and the bottom surface 50 are both on the work surface to allow toe-nailing of the fastener.

During use, the user inserts their fingers into one or both of the members 48. The user then inserts fastener 40, such as a nail for example, into the gap between the inner surfaces 32, 60. The fastener 40 is retained by the magnetic members 52, 70 in position without the user having to squeeze the holder 20 as the user orients their hand to the desired location. Once the fastener 40 is in the desired location, the user uses a hammer or other similar device to strike the head of the fastener 40. As the hammer strikes the fastener 40, the fastener is driven into the structure causing the head of the fastener to move closer to the top surfaces 71, 72 of the bodies 22, 24. If the hammer strike drives the head of the nail flush with or below the surfaces 71, 72, the impact of the hammer may push on the second portion 34 and fourth portion 56 causing the holder 20 to move laterally relative to the fastener 40 providing feedback to the user that they may remove the holder 20. It should be appreciated that the fastener 40 is supported on the sides, such as by inner surfaces 32, 60 for example, which reduces the risk of the nail buckling when struck by the hammer.

Figure 5:
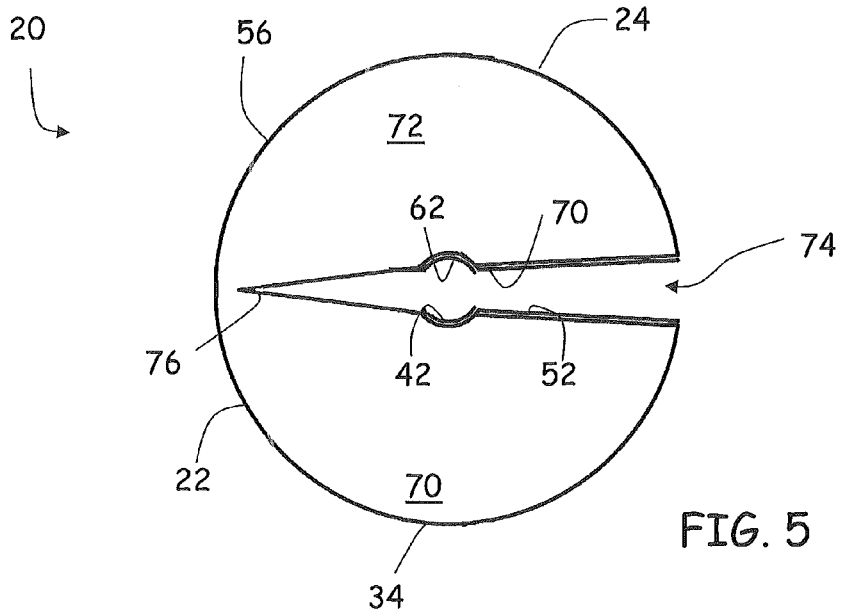
FIG. 5 is a top view of a holder in accordance with another embodiment of the invention.
Figure 6:
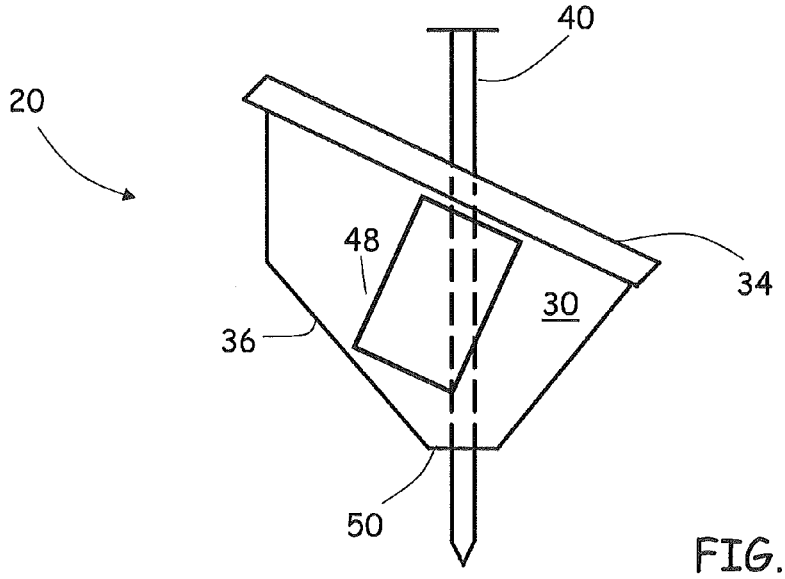
FIG. 6 is a side view of the holder of FIG. 4.

Referring to FIGS. 5 and 6 another holder 20 is shown having a first body 22 and a second body 24 formed from an integral piece of material. In this embodiment, the bodies 22, 24 are formed as a single piece, such as by injection molding for example, with a gap 74 disposed therebetween. The gap 74 includes an open end that is sized to allow insertion of the fastener 40 and a closed end 76. In one embodiment, the closed end 76 forms a wedge-shaped cross section that allows the bodies 22, 24 to be rotated relative to each other. In this embodiment, the material of the holder 20 between the closed end 76 and the outer surface forms a living hinge.

Figure 7:
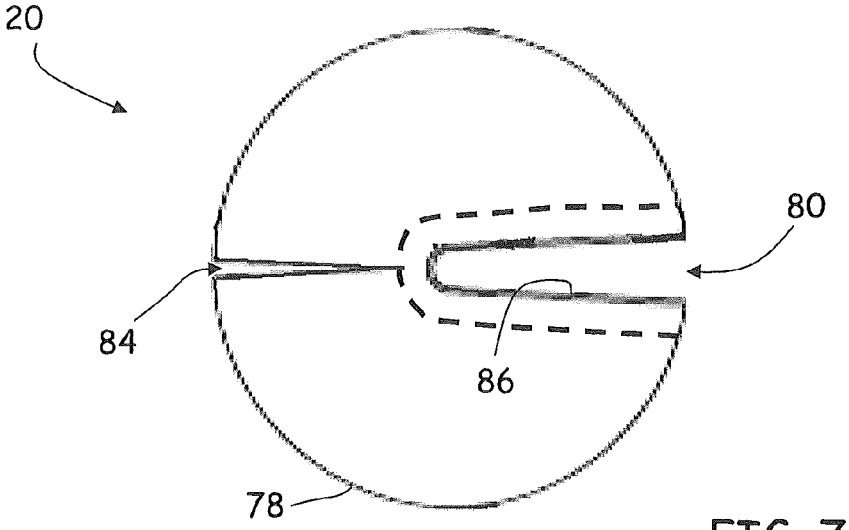
FIG. 7 is a top view of a holder in accordance with another embodiment of the invention; and, FIG. 8 is a side view of a the holder of FIG. 6.
Figure 8:
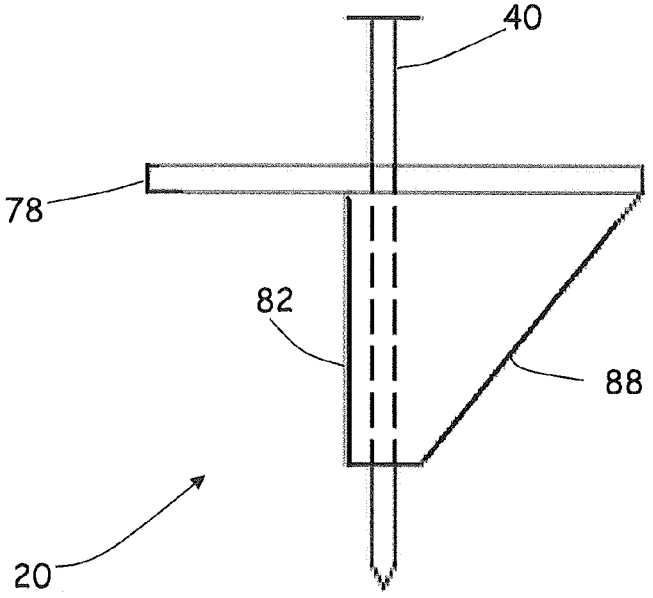

Referring to FIGS. 7 and 8, another holder 20 is shown in accordance with another embodiment of the invention. The holder 20 includes a first planar and generally circular body 78. A slot 80 is formed on one side of the body 78. A wall 82 extends away from the body 78 on either side of the slot 80. A second slot 84 is formed in the body 78 opposite the slot 80. The slots 80, 84 cooperate to allow the user to change the size of the slot 80 by squeezing on the wall 82. A magnetic member 86 may be disposed within the slot 80 to assist in retaining the fastener. In one embodiment, the magnetic member 86 may be replaced with a rubber material that facilitates the retaining of the fastener 40 with only minimal effort by the user. The wall 82 may have a surface 88 that is disposed on an angle relative to the slot 80 to allow the fastener 40 to be toe-nailed into the structure.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A holder for fasteners comprising:

a first body having a first portion and a second portion, the second portion extending from one end of the first portion;

a second body rotationally coupled to the first body, the second body having a third portion arranged adjacent the first portion and fourth portion, the fourth portion extending from one end of the third portion adjacent the second portion, the first portion and the third portion defining a gap, the first body and second body movable between an open position and a closed position;

the first portion includes a first slot adjacent the second body;

the third portion includes a second slot adjacent the first slot;

the first body and the second body cooperate to hold the first fastener when in the closed position;

a first elastic member coupled to the first body on a first surface opposite the gap, the first elastic member sized to receive a user's finger;

a second elastic member coupled to the second body on a second surface opposite the gap, the second elastic member sized to receive a user's finger;

a first magnetic member coupled to the first body within the gap;

a second magnetic member coupled to the second body within the gap; and wherein the first magnetic member is disposed within the first slot and the second magnetic member is disposed within the second slot, the first magnetic member and the second magnetic member being configured to retain a fastener when the first body and the second body are in the open position.

2. The holder of claim 1 wherein:

the first portion includes a third slot adjacent the second body;

the third portion includes a fourth slot adjacent the third slot; and, the third slot and the fourth slot cooperating to hold a second fastener when in the closed position, the second fastener being larger than the first fastener.

3. The holder of claim 2 wherein:

the first portion includes a fifth slot adjacent the second body;

the third portion includes a sixth slot adjacent the fifth slot; and, the fifth slot and the sixth slot cooperating to hold a third fastener when in the closed position, the third fastener being smaller than the first fastener.

4. The holder of claim 2 wherein the first magnetic member is further disposed in the third slot and the second magnetic member is further disposed in the fourth slot.

5. The holder of claim 1 further comprising a hinge member rotationally coupling the first body to the second body.

6. The holder of claim 5 wherein the hinge member is a living hinge and the first body and the second body are integrally formed.

7. The holder of claim 1 wherein the first magnetic member is a strip of material.

8. The holder of claim 1 wherein the first portion includes a third surface disposed on an angle relative to the second portion, and the third portion includes a fourth surface disposed on the angle relative to the fourth portion.

9. The holder of claim 8 wherein the third surface is disposed on a 45 degree angle and the fourth surface is disposed on a 45 degree angle.

10. A holder for fasteners comprising:

a first body having a first portion and a second portion, the second portion extending from one end of the first portion;

a second body rotationally coupled to the first body, the second body having a third portion arranged adjacent the first portion and fourth portion, the fourth portion extending from one end of the third portion adjacent the second portion, the first portion and the third portion defining a gap, the first body and second body movable between an open position and a closed position;

the first body includes a first surface adjacent the gap, the first surface having at least one first slot;

the second body includes a second surface adjacent the gap, the second surface having at least one second slot;

the at least one first slot and the at least one second slot cooperate to removably retain a fastener when the first body and the second body are moved to a closed position;

a first elastic member coupled to the first body on a surface opposite the gap, the first elastic member sized to receive a user's finger;

a second elastic member coupled to the second body on a surface opposite the gap, the second elastic member sized to receive a user's finger;

a first magnetic member coupled to the first body within the gap;

a second magnetic member coupled to the second body within the gap; and wherein the first magnetic member is disposed within at least one first slot and the second magnetic member is disposed within the at least one second slot, the first magnetic member and the second magnetic member being configured to retain a fastener when the first body and the second body are in an open position.

11. The holder of claim 10 wherein the first magnetic member is embedded with the first body and the second magnetic member is embedded within the second body.

12. The holder of claim 10 further comprising a hinge member rotationally coupling the first body and the second body.

13. The holder of claim 10 wherein the first portion includes a third surface on one side and the third portion includes a fourth surface adjacent the third surface, the third surface and the fourth surface being disposed on an angle relative to the second portion.

14. The holder of claim 13 wherein the third surface is disposed on a 45 degree angle and the fourth surface is disposed on a 45 degree angle.

15. The holder of claim 10 further comprising a rubber liner coupled to the first body within the gap.

* * * * *